US007971733B2

(12) United States Patent
Ponto

(10) Patent No.: US 7,971,733 B2
(45) Date of Patent: Jul. 5, 2011

(54) WINDOW PALLET AND METHOD OF USE THEREOF

(75) Inventor: Leanna L. Ponto, Valley Center, CA (US)

(73) Assignee: AMCOR Packaging Distribution, Buena Park, CA (US)

( * ) Notice: Subject to any disclaimer, the term of this patent is extended or adjusted under 35 U.S.C. 154(b) by 733 days.

(21) Appl. No.: 11/901,899

(22) Filed: Sep. 18, 2007

(65) Prior Publication Data

US 2009/0071381 A1 Mar. 19, 2009

(51) Int. Cl.
*A47G 19/08* (2006.01)

(52) U.S. Cl. ..... 211/41.14; 108/55.1

(58) Field of Classification Search ..... 211/41.14, 211/41.15, 13.1, 41.17, 85.13, 61, 67, 70.7, 211/184, 189, 85, 195; 108/55.5, 55.1, 52.1; 206/386, 600

See application file for complete search history.

(56) References Cited

U.S. PATENT DOCUMENTS

| | | | | | |
|---|---|---|---|---|---|
| 2,679,321 | A | * | 5/1954 | Koeferl | 211/50 |
| 2,936,985 | A | * | 5/1960 | Doerr et al. | 108/55.1 |
| 3,133,687 | A | | 5/1964 | Fremion | |
| 3,139,205 | A | * | 6/1964 | Haubrich | 217/47 |
| 3,147,860 | A | * | 9/1964 | Kean, Sr. et al. | 206/448 |
| 3,402,845 | A | * | 9/1968 | Eriksson | 220/1.5 |
| 3,405,665 | A | * | 10/1968 | Slonim | 108/55.1 |
| 3,499,398 | A | * | 3/1970 | Murray | 108/53.5 |
| 3,557,855 | A | * | 1/1971 | Weingarten et al. | 206/386 |
| 3,620,388 | A | * | 11/1971 | Mansson | 108/53.1 |
| 3,735,713 | A | * | 5/1973 | Glassmeyer | 108/53.5 |
| 3,937,329 | A | | 2/1976 | Hammerel | |
| 3,990,576 | A | | 11/1976 | Heaney | |
| 4,453,471 | A | | 6/1984 | Harrington | |
| 4,899,891 | A | | 2/1990 | Sipilä et al. | |
| 5,076,457 | A | * | 12/1991 | Marovskis | 220/6 |
| 5,105,946 | A | | 4/1992 | McDowell | |
| 5,174,448 | A | | 12/1992 | Flaig | |
| 5,253,763 | A | * | 10/1993 | Kirkley et al. | 206/600 |
| 5,605,229 | A | * | 2/1997 | Sowa | 206/454 |
| 5,641,076 | A | | 6/1997 | Englund | |
| 5,720,228 | A | * | 2/1998 | Clive-Smith | 108/55.1 |
| 5,810,186 | A | * | 9/1998 | Lam | 220/1.5 |
| 5,950,836 | A | * | 9/1999 | Iwamoto et al. | 206/711 |
| D423,179 | S | | 4/2000 | Horner et al. | |
| D466,690 | S | | 12/2002 | Walsh | |
| 6,520,364 | B2 | * | 2/2003 | Spykerman et al. | 220/6 |
| 6,543,370 | B2 | * | 4/2003 | Bae | 108/55.1 |
| 6,588,605 | B1 | * | 7/2003 | Volkert et al. | 211/41.14 |
| 6,742,663 | B2 | * | 6/2004 | Chubb | 211/41.14 |
| 7,014,402 | B2 | * | 3/2006 | Kessler | 410/155 |
| 7,624,887 | B2 | * | 12/2009 | Avery | 220/9.2 |
| 7,802,526 | B2 | * | 9/2010 | Brady et al. | 108/53.5 |
| 2007/0256995 | A1 | * | 11/2007 | Tenreiro et al. | 211/85.7 |
| 2008/0217276 | A1 | * | 9/2008 | Brady et al. | 211/195 |

OTHER PUBLICATIONS

Color photographs of a patio door pallet manufactured by American Containers, Inc. prior to Sep. 2007; 6 pages.
Color photograph of a window pallet manufactured by American Containers, Inc. prior to Sep. 2007; 1 page.

* cited by examiner

*Primary Examiner* — Darnell M Jayne
*Assistant Examiner* — Stanton L Krycinski
(74) *Attorney, Agent, or Firm* — Martin & Ferraro, LLP

(57) ABSTRACT

A pallet for holding at least one window frame includes a base and movable sides pivotally attached to the base. The movable sides are positionable to be substantially perpendicular to the base and are configured to hold the window frame. Connectors attached to the base and the movable sides, respectively, prevent the first and second movable sides from moving away from each other. A method for using the pallet is also disclosed.

28 Claims, 9 Drawing Sheets

WINDOW PALLET AND METHOD OF USE THEREOF

BACKGROUND

1. Field of the Invention

The present invention relates generally to pallets used for loading, holding, storing, and transporting commercial products, and more specifically, to a pallet for storing and transporting fragile items such as window frames.

2. Description of the Related Art

Conventional pallets are platforms used to hold and transport cargo loads of various types. The structure of a conventional pallet typically includes an upper portion and a lower portion separated by support blocks. The cargo loaded pallets are typically moved around by forklifts and pallet jacks.

Various pallets have been used to transport window frames. A typical pallet may include a base and two movable sides. The base is usually made of wood and the movable sides are usually made of plastic. After a window frame is placed onto a pallet, the two movable sides are brought into vertical positions and secured to the loaded window frames. Prior pallets have various disadvantages that make their use time consuming and cost-inefficient.

In the past, when window frames were loaded onto the base of the pallet, the fins extending from the frames were placed directly onto the pallet. The windows were not secured to the pallets in a stable upright position and had to be held from the sides. Since the fin is structurally weaker than the frame itself, placement of window frames with their fins directly on the wooden surface of the pallets such that the weight of the frame is supported by the fin could result in damage to the fins during storage or transportation.

During loading, the windows cannot stand upright with their fins resting on the base of the pallet without being held up by a person. A second person is needed to bring each of the movable sides into an upright position and affix the movable sides to the loaded window frames. The use of two people to load and unload pallets significantly increases the labor costs to load and unload the pallets of the past.

Another disadvantage of the prior pallets is that the plastic sides of the pallets cannot be affixed to the window frames without a fastener, such as a screw or a staple, that is driven through the frame itself. Intermediate blocks were typically attached by screws to the movable sides and the fins of the window frames were attached to the intermediate blocks by additional screws.

It is typical in the industry to use pallets that can be loaded with more than one window frame at one time. Typically, 7-13 window frames are loaded onto a pallet, with nine window frames being preferred. In pallets with nine frames, nine intermediate blocks would be attached to each one of the movable sides by one screw. A fin of each window frame would be attached by two screws to one block on one movable side and by two more screws to a second block on the second movable side. Thus, to load nine window frames onto a pallet, 54 screws and 18 wooden blocks were used to affix nine frames to the movable sides of a pallet. The use of a large number of intermediate blocks and screws to attach window frames to the movable sides of the pallets significantly increases the amount of time and labor required to load the window frames onto the pallet and the amount of time and labor required to unload the window frames from the pallet. As a result, the use of such pallets incurred significant costs.

There exists a need for a pallet for holding window frames for storage and transportation that can be easily loaded or unloaded by one person and that securely holds the window frames without attaching each frame individually to the pallet by one more fasteners.

SUMMARY OF INVENTION

The present invention is directed to a pallet for holding fragile items such as, for example, window frames, glass windows, glass doors, and the like during storage and transportation of those items. The pallet includes movable sides with slots configured to receive a fin of a window frame loaded onto the pallet. One of the movable sides of the pallet is fixed by a plurality of straps in a position that facilitates loading and unloading of the window frames by a single person. When secured on the pallet within the slots and between the movable sides of the pallet, the window frames can be safely transported or stored even when pallets are stacked on top of one another. The movable sides of the pallet can be positioned in a collapsed or closed position that allows the pallet to be efficiently stored when not in use.

In a preferred embodiment, a pallet for holding a window frame includes a base having a first end, a second end opposite the first end, a length extending therebetween, a width transverse to the length, a top, and a bottom. At least one support member on the top of the base includes at least one slot oriented along the length of the base configured to receive a portion of the window frame. A first movable side and a second movable side each have a top end, a bottom end, a length extending therebetween, and a width transverse to the length. The bottom end of the first movable side and the bottom end of the second movable side are each pivotally attached to the base of the pallet proximate the first and second ends of the base, respectively. The first and second movable sides are movable from a first position to a second position wherein the first and second sides are substantially perpendicular to the top of the base. A first divider is attached to the first movable side and a second divider attached to the second movable side. The first and second dividers extend across a portion of the width of a respective one of the first and second movable sides. Each of the dividers have a first end, a second end, a longitudinal axis extending therebetween, and at least one slot oriented transverse to the longitudinal axis of each of the dividers and configured to receive respective portions of the window frame. Straps are included each having a first portion attachable to the base of the pallet and a second portion attachable to one of the first and second movable sides. The straps, when attached to the base and the first and second movable sides, respectively, prevent the first and second movable sides from moving away from each other when the first and second movable sides are in the second position.

In another preferred embodiment, a pallet for holding a window frame comprises a base having a first end, a second end opposite the first end, a length extending therebetween, a width transverse to the length, a top, and a bottom. A first movable side and a second movable side each have a top end, a bottom end, a length extending therebetween, and a width transverse to the length. The first movable side and the second movable side each include at least one slot configured to receive a portion of the window frame. The bottom end of said first movable side and the bottom end of the second movable side are each pivotally attached to the base proximate the first and second ends of the base, respectively. The first and second movable sides are movable from a first position to a second position wherein the first and second sides are substantially perpendicular to the top of the base. Straps are included each having a first portion attachable to the base and a second portion attachable to one of the first and second movable sides. The straps, when attached to the base and the first and second movable sides, respectively, prevent the first and second movable sides from moving away from each other when the first and second movable sides are in the second position.

In a preferred embodiment of a method for holding window frames for storage or transportation, the method comprises providing a pallet including a base having a top, and a bottom, at least one support member on the top of the base, a first movable side pivotally attached to the base and a second movable side pivotally attached to the base, a first divider on the first movable side and a second divider on the second movable side. Each of the first and second dividers has a first end, a second end, and a longitudinal axis therebetween. Straps are included having a first portion attachable to the base and a second portion attachable to one of the first and second movable sides, the first support member and the first and second dividers each including at least one slot configured to receive a portion of the window frame. Positioning the first movable side substantially perpendicular to the top of the base. Attaching the first portions of at least two of the straps to the base and attaching the second portions of the straps to the first movable side to prevent the first movable side from moving away from the second movable side when the first movable side is in the substantially perpendicular position. Loading at least one window frame onto the pallet to place a first portion of the window frame into the slot of the first support member and a second portion of the window frame into the slot of the first divider. Positioning the second movable side substantially perpendicular to the base and inserting a third portion of the window frame into the slot of the second divider. Attaching the first portions of at least two of the straps to the base and attaching the second portions of the straps to the second movable side to prevent the second movable side from moving away from the first movable side when the second movable side is in the substantially perpendicular position.

DETAILED DESCRIPTION OF THE PREFERRED EMBODIMENTS

Reference will now be made in detail to the preferred embodiments, examples of which are illustrated in the accompanying drawings. Wherever possible, the same reference numbers will be used throughout the drawings to refer to the same or like parts.

In a preferred embodiment, a pallet for holding windows protects three sides of a window frame during storage and transportation. The pallet includes movable sides having slots configured to receive a fin of a window frame loaded onto the pallet. A movable side of the pallet is fixed by a plurality of straps in a stationary position, allowing easy loading and unloading of the window frames onto or from the pallet by a single person. When loaded on the pallet and into the slots of the side fixed by straps, the window frames are in a secure upright position and do not need to be manually held up to prevent from falling. When window frames are secured on the pallet within the slots of and between both movable sides, the window frames can be safely transported or stored. The loaded pallets can be stacked on top of one another. The pallet itself can be made compact for efficient storage when not in use with the movable sides placed in a closed position.

Figure 1:
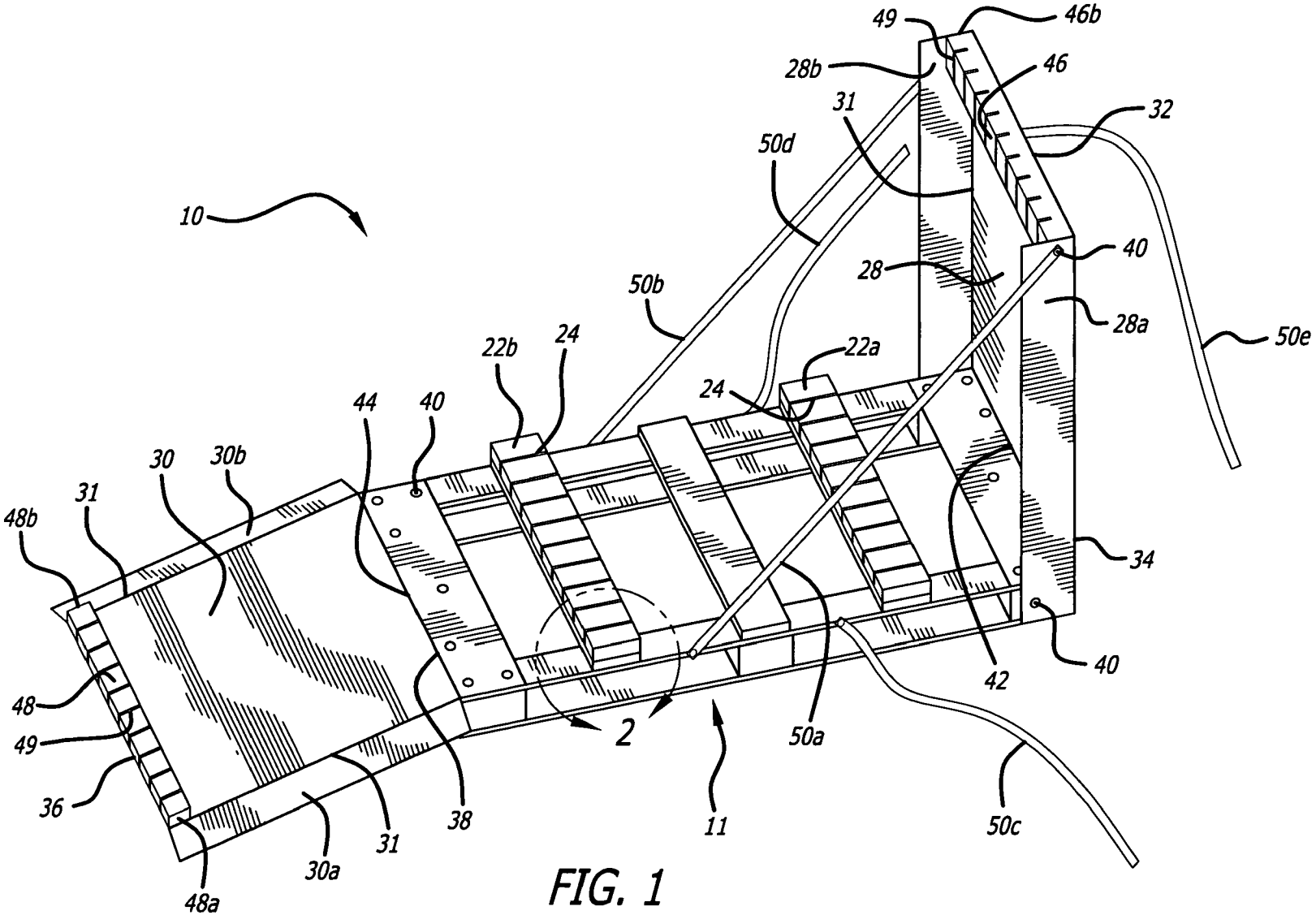
FIG. 1 is a perspective side view of an embodiment of a window pallet.
Figure 5:
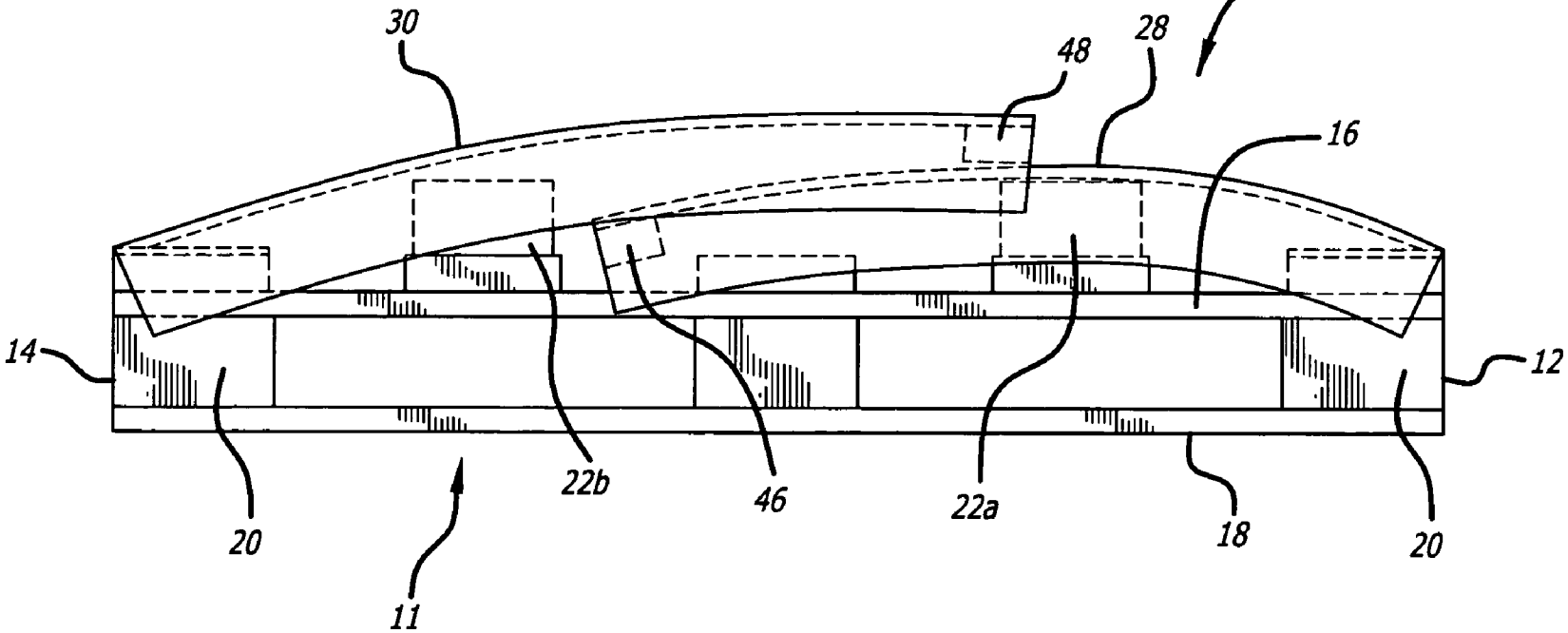
FIG. 5 is a side elevational view of the pallet with the movable sides in a collapsed position.

Referring now to the drawings and particularly to FIGS. 1 and 5, a pallet for transporting window frames is shown and generally designated by the numeral 10. Pallet 10 has a base 11 including a first end 12, a second end 14 opposite first end 12, a length extending therebetween, and a width transverse to the length. Base 11 of pallet 10 includes a top 16 and a bottom 18. Top 16 and bottom 18 have a plurality of support blocks 20 therebetween.

In a preferred embodiment, base 11 of pallet 10 has a width of 28¾ inches and a length of 38½ inches. Base 11 can have a wide variety of dimensions based on the size and the number of window frames to be transported. By way of example, base 11 can have the following dimensions: (1) length 26½ in., width 28¾ in.; (2) length 50½ in., width 28¾ in.; (3) length 62½ in., width 28¾ in.; and (4) length 74½ in., width 28¾ in.

As shown in FIG. 1, pallet 10 has two support members 22*a*, 22*b*. Preferably, support members 22*a*, 22*b* are oriented across the length of pallet 10 and extend along substantially the entire width of pallet 10. Support members 22*a*, 22*b* preferably each have nine slots 24, allowing nine window frames to be loaded onto pallet 10 at one time. Slots 24 of support members 22*a*, 22*b* are oriented along the length of base 11. Preferably, each of the nine slots 24 of support member 22*a* has a corresponding slot 24 in support member 22*b* so that the respective slots 24 of support members 22*a*, 22*b* are substantially colinear and are adapted to receive portions of the same window frame.

The width of base 11 and the number of slots 24 of support members 22*a*, 22*b* could be increased or decreased to permit pallet 10 to accommodate a varying number of window frames at one time. In addition, the nine-slot support members 22*a*, 22*b* could each be replaced by, for example, nine distinct support members (not shown) each having one slot.

Support-members 22*a*, 22*b* of pallet 10 are preferably made of a material capable of supporting the weight of nine window frames at a time without being substantially deformed. In a preferred embodiment, support members 22*a*, 22*b* are made of a cardboard material including a honeycomb structure such as HEXACOMB® sold by Pregis Corporation. The internal structure of support members 22*a*, 22*b* is shown in more detail in FIG. 2. Alternatively, support members 22*a*, 22*b* could be made of any other material suitable for the purpose of supporting window frames such as, for example, plastic, foam, wood, rubber, metal, and the like.

Figure 2:
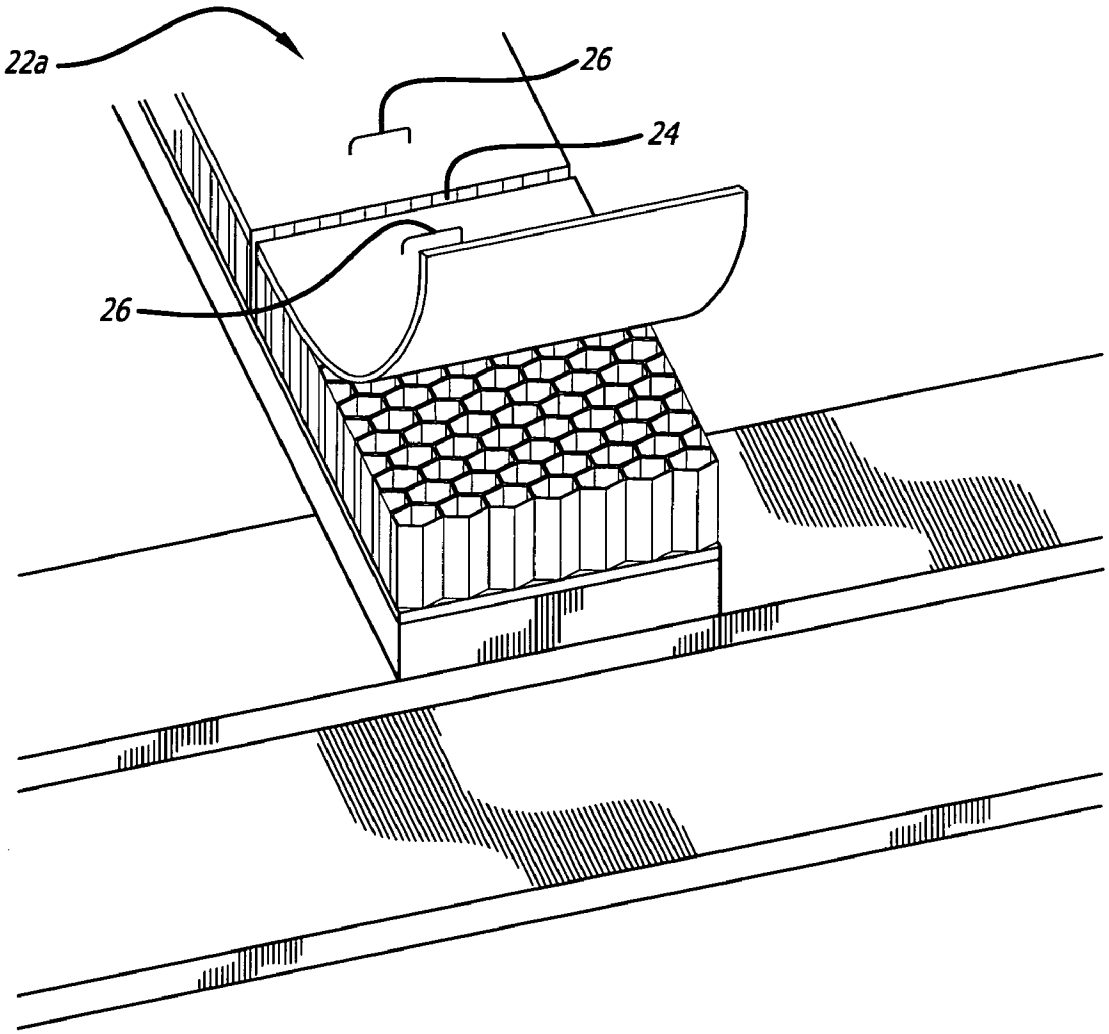
FIG. 2 is an enlarged fragmentary view along line 2 of FIG. 1 illustrating a support member of the pallet.

Support members 22*a*, 22*b* are preferably attached to top 16 of base 11 by fasteners such as, for example, staples 26, shown in FIG. 2. Alternatively, support members 22*a*, 22*b* could be attached to top 16 of base 11 by a suitable commercially available adhesive or adhesive tape, or by a combination of mechanical fasteners and an adhesive or adhesive tape.

As shown in FIG. 1, pallet 10 includes a first movable side 28 and a second movable side 30. The first and second movable sides 28, 30 are preferably made of a corrugated plastic material that is commercially available, such as, for example, the plastic material sold by COROPLAST of Dallas, Tex. First and second movable sides 28, 30 could be made of any other material suitable for the intended purpose such as, for example, other plastics, cardboards, acrylics, or metals.

First movable side 28 has a top end 32 and a bottom end 34. First movable side 28 includes flaps 28*a*, 28*b* extending along the length of first movable side 28 between top end 32 and bottom end 34. Second movable side 30 has a top end 36 and bottom end 38. Second movable side 30 includes flaps 30*a*, 30*b* extending along the length of second movable side 30 between top end 36 and bottom end 38. Movable sides 28, 30 include folds 31 that permit flaps 28*a*, 28*b*, 30*a*, and 30 *b* to pivotally move from an open position to a closed position. Typically, folds 31 are created by die cutting, welding, or scoring, or any other method of weakening the material of movable sides 28, 30 well known to those of ordinary skill in the art.

In FIG. 1, flaps 30*a*, 30*b* are shown in an open position and flaps 28*a*, 28*b* are shown in a closed position. Flaps 28*a*, 28*b*, 30*a*, and 30*b* provide an additional supporting enclosure to the window frames loaded onto pallet 10 between movable sides 28, 30, and help to keep window frames from moving on pallet 10 during transportation and storage.

Bottom end 34 of first movable side 28 and bottom end 38 of second movable side 30 are attached to base 11 by a plurality of screws 40. Alternatively, by way of example, staples, nails, or an adhesive material may be used instead of screws 40 to attach bottom ends 34, 38 of first and second movable sides 28, 30 to base 11. Although bottom end 34 of first movable side 28 and bottom end 38 of second movable side 30 are shown in the drawings as being attached to top 16 of base 11, they also could be attached to base 11 at a different location, for example, at ends 12, 14 of base 11.

As shown in FIG. 1, first movable side 28 includes a hinge 42 proximate bottom end 34 and second movable side 30 includes a hinge 44 proximate bottom end 38. Hinges 42, 44 permit first and second movable sides 28, 30, respectively, to pivotally move with respect to top 16 of base 11. Typically, hinges 42, 44 are formed in first and second movable sides 28, 30 by die cutting. Alternatively, hinges 42, 44 may be formed by welding (e.g., heat, laser), scoring, or other techniques providing for increased flexibility of a plastic material.

The range of motion of first movable side 28 is typically from a position substantially perpendicular to top 16 of base 11 shown in FIG. 1 to a closed or collapsed position shown in FIG. 5. The range of motion of second movable side 30 is typically from an open position shown in FIG. 1 to a closed or collapsed position shown in FIG. 5. The closed position of first and second movable sides 28, 30 of pallet 10 allows the pallet to be compact for efficient use of storage space when not in use.

In a preferred embodiment, first and second movable sides 28, 30 each include slots 49 configured to receive portions of a window frame. Slots 49 could be formed directly in first and second movable sides 28, 30. Alternatively, first and second movable sides 28, 30 could each include an attached slotted member such as described below.

Figure 3:
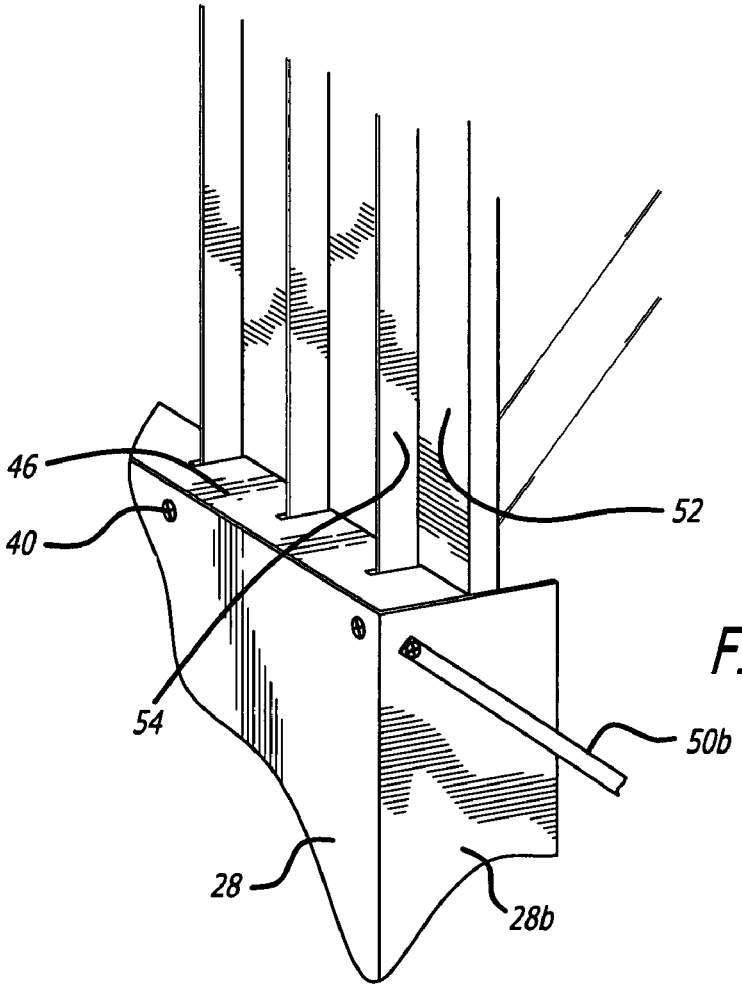
FIG. 3 is an enlarged fragmentary perspective view of a portion of a movable side of the pallet and portions of window frames.

Referring to FIG. 1, first movable side 28 includes a first divider 46 and second movable side 30 includes a second divider 48. Dividers 46, 48 each include a first end 46*a*, 48*a* and a second end 46*b*, 48*b*, respectively, and a length between first ends 46*a*, 48*a* and second ends 46*b*, 48*b*. Dividers 46, 48 include a plurality of slots 49 oriented transverse to their length. As shown in FIG. 3, dividers 46, 48 are attached to first and second movable sides 28, 30, respectively, by screws 40. Alternatively, by way of example, staples, nails, an adhesive material, an adhesive tape, or another suitable material may be used instead of screws 40 to attach dividers 46, 48 to movable sides 28, 30 of pallet 10. In the preferred embodiment, dividers 46, 48 are made of wood. Dividers 46, 48 could be made of other materials, for example, plastic, rubber, foam, cardboard, HEXACOMB®, or metal.

Figure 6:
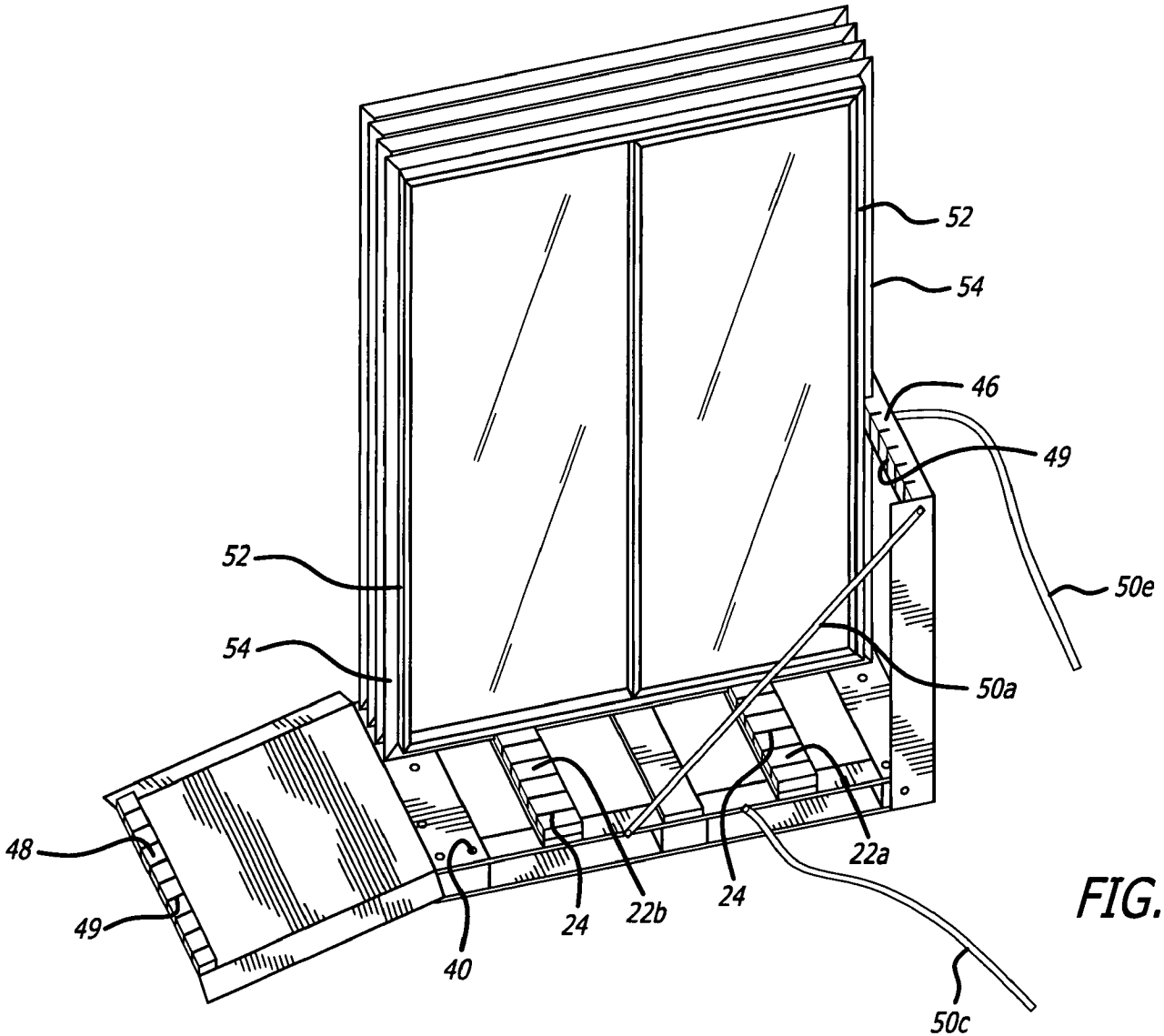
FIG. 6 is a perspective view of the pallet partially loaded with window frames and with the window frames fully secured.

As shown in FIG. 6, in a preferred embodiment three screws 40 are used to attach each of dividers 46, 48 to a respective first and second movable side 28, 30. Accordingly, the pallet of the present invention only requires six screws to securely hold nine window frames in two movable sides, providing a significant advantage over prior pallets that required fifty four screws to achieve the same objective.

As shown in FIG. 1, pallet 10 includes connectors, such as straps 50*a*-50*d* in the preferred embodiment, to connect movable sides 28,30 and base 11. Straps 50*a*-50*d* can be made of a material, such as for example, hook and loop tape, nylon, and polypropylene, or any other material suitable for their intended purpose. Straps 50*a*-50*d* each have a first end attached to base 11. Preferably, straps 50*a*-50*e* are attached to base 11 and movable sides 28, 30 of pallet 10 by screws 40. Alternatively, staples, nails, other fasteners, or an adhesive could be used. Although straps 50*a*-50*d* are shown in the drawings as being connected by their ends to a respective one of base 11 and movable sides 28, 30, straps 50*a*-50*d* could also be attached to base 11 and movable sides 28, 30 at points or portions proximate the ends of straps 50*a*-50*d*.

As shown in FIG. 1, straps 50*a* and 50*b* each have a second end attached to first movable side 28. The second end of strap 50*a* is attached to first movable side 28 at first end 46*a*of divider 46 and the second end of strap 50*b* is attached to first movable side 28 at second end 46*b*of divider 46. The second ends of straps 50*a* and 50*b* do not necessarily have to be attached to ends 46*a*, 46*b* of divider 46, but could be attached at a different point of first movable side 28. Strap 50*a* and flap 28*a* are preferably attached to first end 46*a* of divider 46 together with one screw 40. Similarly, the strap 50*b* and flap 28*b* are preferably attached to second end 46*b* of divider 46 together with one screw 40.

Figure 4:
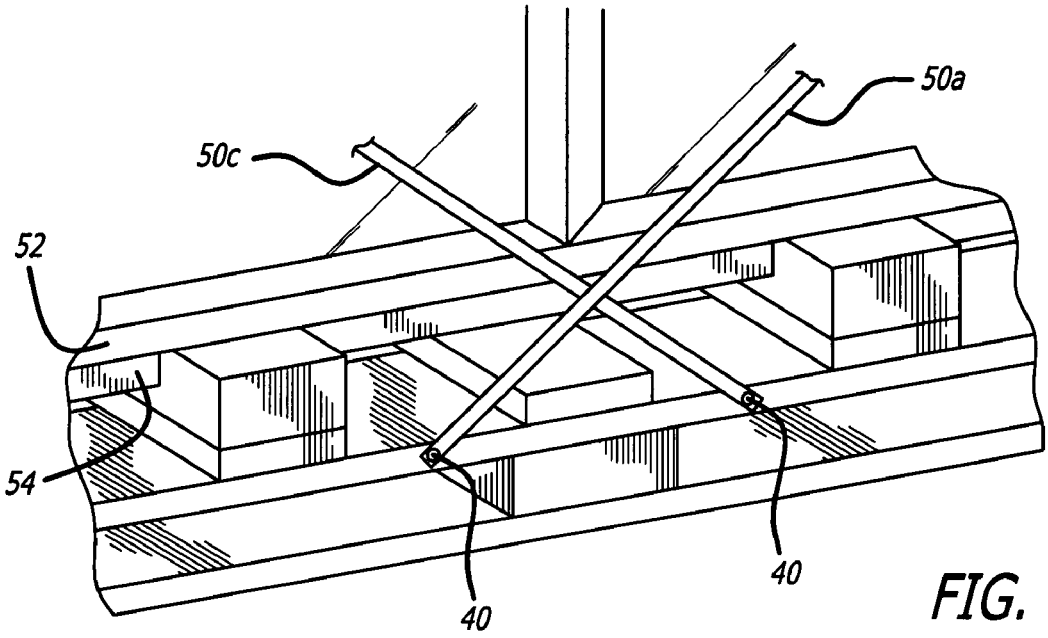
FIG. 4 is an enlarged fragmentary perspective view of a portion of the base of the pallet of the present invention.

FIGS. 1 and 6 show pallet 10 in a loading and unloading position. First movable side 28 is held by straps 50*a* and 50*b* in a position substantially perpendicular to top 16 of base 11. An enlarged fragmentary view of the attachment of straps to base 11 and to first movable side 28 is shown in FIGS. 3 and 4, respectively. The point of attachment of straps 50*a*-50*d* to first and second movable sides 28, 30 is shown in the drawing figures by way of example only, and other suitable attachment points could be used instead. In addition, the ends of straps 50*a*-50*d* do not have to be attached to base 11 or movable sides 28, 30, as straps 50*a*-50*d* could be attached to base 11 and movable sides 28, 30 at points or portions proximate to their ends.

Straps 50*c* and 50*d* are shown in FIGS. 1 and 6 as having one end attached to base 11 and one free end that is attached to second movable side 30 after movable side 30 brought into a position substantially perpendicular to top 16 of base 11 for illustration purposes only. Straps 50*c* and 50*d* do not have to be pre-attached to either base 11 or movable sides 28, 30, and could be attached by screws 40 after window frames 52 are loaded onto pallet 10 and after second movable side 30 is brought into the position shown in FIG. 7.

The length of straps 50*a* and 50*b* and the points of their attachment to base 11 are preferably chosen such that straps 50*a* and 50*b* prevent first movable side 28 from moving away from second movable side 30 when first movable side 28 is in a position substantially perpendicular to top 16 of base 11.

FIG. 6 shows pallet 10 loaded with four window frames 52. As each window frame 52 is loaded onto pallet 10, a fin 54 extending from window frame 52 is inserted into a slot 24 of support member 22*a*, a slot 24 of support member 22*b*, and a slot 49 of divider 46. Preferably, the depth of slots 49 of divider 46 permits fin 54 to fit into a slot 49 such that a side of window frame 52 is flush with a surface of divider 46, as shown, for example in FIG. 3. Similarly, it is preferred that the depth of slots 24 of support members 22*a*, 22*b* permits fin 54 to slide into a slot 24 of each of the support members 22*a*, 22*b* such that a side of the window frame 52 sits flush on top of support members 22*a*, 22*b*, as shown, for example, in FIG. 4.

As shown in FIG. 6, when window frames 52 are placed on pallet 10, they are in a secure upright position and do not need to be manually supported to prevent them from falling. Slots 24 of support members 22*a*, 22*b* and slots 49 of divider 48 allow window frames 52 to be securely loaded on pallet 10 without the use of any fasteners to affix portions of window frames 52 to movable sides 28, 30 or to each other. This provides a significant advantage in that pallet 10 can be fully loaded with window frames using less parts and in considerably less time than the previously used pallets. Straps 50*a* and 50*b* secure first movable side 28 in the loading and unloading position so that window frames 52 can be loaded onto pallet 10 by a single person. With window frames 52 loaded onto pallet 10 and with first movable side 28 fixed as shown in FIG. 6, a person loading the frames can load additional frames or manipulate second movable side 30 into an appropriate position, without an additional person to hold up either movable side 28 or the loaded window frames 52.

Similarly, when window frames 52 are on pallet 10 when first and second movable sides 28, 30 are in positions shown in FIG. 6, window frames 52 can be unloaded from pallet 10 by a single person without a second person to hold up movable side 28 or window frames 52. This provides a significant advantage over pallets of the prior art the unloading of which typically required two or more people. Since window frames 52 are not affixed to base 11 or movable sides 28, 30 by any screws, window frames 52 are unloaded from pallet 10 by simply removing fins 54 of window frames 52 from slots 24 of support members 22*a*, 22*b*, and from slots 49 of divider 46, without the use of tools such as screwdrivers or screw guns. This provides a significant advantage over previously used pallets which typically required each frame to be individually unscrewed from each of the movable sides of the pallet at the time of unloading. In addition, situations where the pallet was destroyed to remove the window frames and parts of the pallet remained attached to the window frames are avoided.

Figure 7:
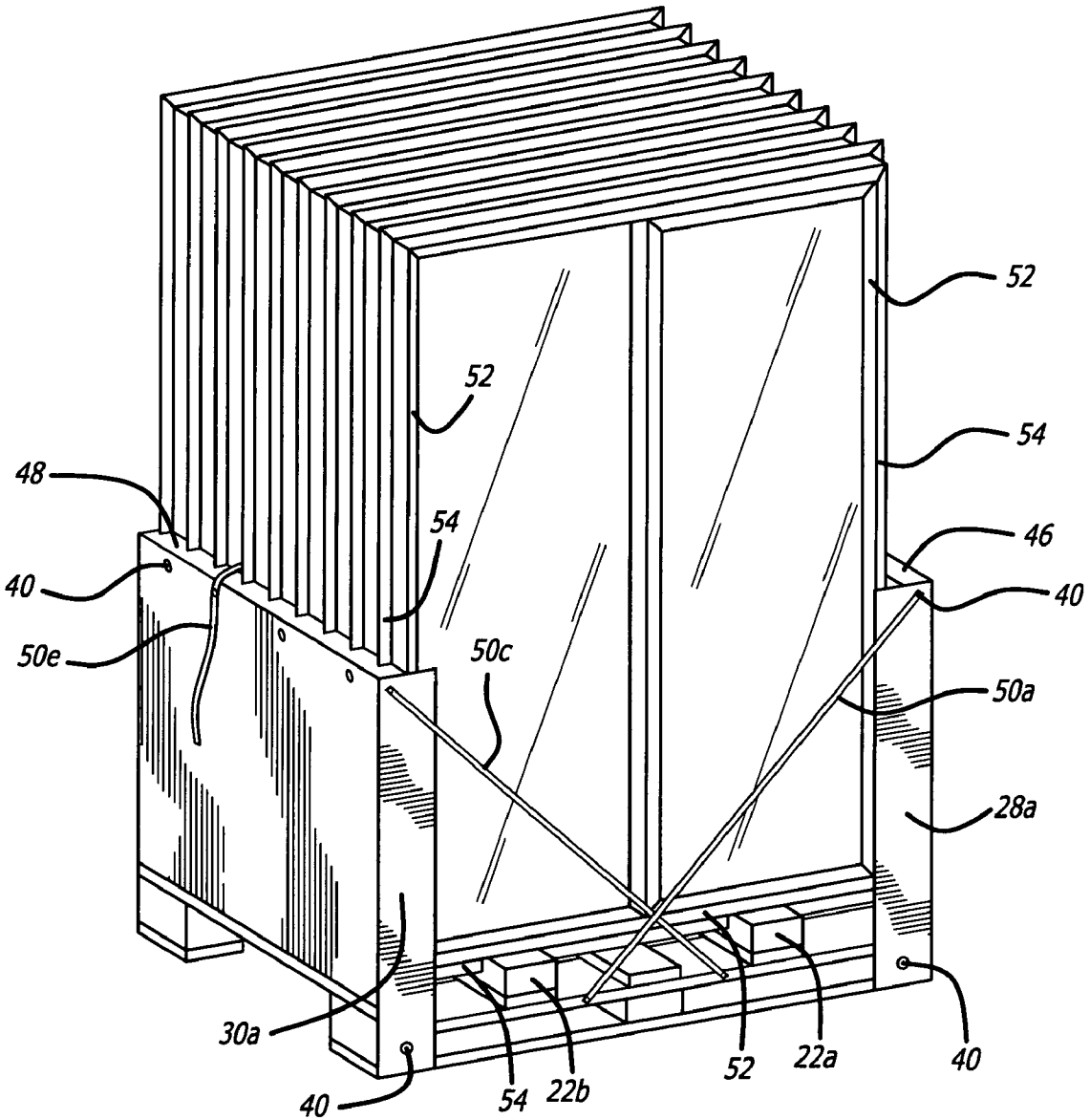
FIG. 7 is a side perspective view of the pallet loaded with window frames and the window frames secured to the pallet.

As shown in FIG. 7, after all nine window frames 52 are loaded onto pallet 10, second movable side 30 is brought into a position substantially perpendicular to top 16 of base 11, and a fin 54 of each of the loaded window frames 52 is inserted into one of the slots 49 of divider 48 of second movable side 30. In addition, the second ends of straps 50*c* and 50*d* are attached to second movable side 30. Preferably, second end of strap 50*c* is attached to first end 48*a* of divider 48 and second end of strap 50*d* is attached to second end 48*b* of divider 48. Attachment of second ends of straps 50*c* and 50*d* to second movable side 30 further secures window frames 52 on pallet 10 and prevents second movable side 30, when in the substantially perpendicular position, from moving away from first movable side 28.

The second end of strap 50*c* and flap 30 *a* are preferably attached to first end 48*a* of divider 48 together with one screw 40. Similarly, the second end of strap 50*d* and flap 30 *b* are preferably attached to second end 48*b* of divider 48 together with one screw 40. As shown in FIG. 7, flaps 28*a* and 30 *a*of first and second movable sides 28, 30 are each attached to a support block 20 of base 11 by a screw 40. Flaps 28*b* and 30 *b* are similarly attached to a support block 20 of base 11 by a screw 40. The attachment of flaps 28*a*, 28*b*, 30 *a*, and 30 *b* to a support block 20 of base 11 provides a more secure enclosure for window frames 52 and eliminates a loose end on each of the flaps.

As shown in FIGS. 1 and 7, pallet 10 includes a securing strap 50*e* having a first end attached to first movable side 28. After window frames 52 are loaded onto pallet 10 and movable sides 28, 30 are in a position shown in FIG. 7, securing strap 50*e* is extended between window frames 52 along the length of base 11 and attached to second movable side 30. Preferably, the first and second ends of securing strap 50*e* are attached to first and second movable sides 28, 30, respectively, by a screw 40. One end of strap 50*e* does not have to be pre-attached to movable side 28 and each end of strap 50*e* could be attached to a respective movable side 28, 30 after movable sides 28, 30 are brought into the position shown in FIG. 7. Similarly to straps 50*a*-50*d*, strap 50*e* does not have to be attached to first and second movable sides 28, 30 at its ends and could be attached to first and second movable sides 28, 30 at a point or portion proximate the ends of strap 50*e*.

The length of securing strap 50*e* is typically selected to create a snug fit between fins 54 of loaded window frames 52 and slots 49 of each of dividers 46, 48 after securing strap is attached to second movable side 30. The insertion of fins 54 of window frames 52 into slots 49 of dividers 46, 48 and the subsequent tightening with securing strap 50*e* allows the frames to be securely held on pallet 10 without having to use any fasteners to affix fins 54 of window frames 52 to the first and second movable sides 28, 30. This provides a significant advantage over pallets of the prior art. In addition, the snug fit of movable sides 28, 30 and window frames 52 provided by securing strap 50*e* insures that fins 54 of window frames 52 do not slide within or slip out of slots 49 during transportation of window frames 52.

As shown, for example, in FIG. 7, first movable side 28 has a height as measured from top 16 of base 11 to top end 32 of first movable side 28 and second movable side 30 has a height as measured from top 16 of base 11 to top end 36 of second movable side 30. Preferably, the height of first and second movable sides 28, 30 is selected to provide a sufficiently secure partial enclosure for window frames 52 loaded onto pallet 10. In a preferred embodiment, the heights of first and second movable sides 28, 30 are each approximately two feet to accommodate two foot wide windows. The height of first and second movable sides 28, 30 can be varied based on the size of window frames loaded onto pallet 10.

Figure 8A:
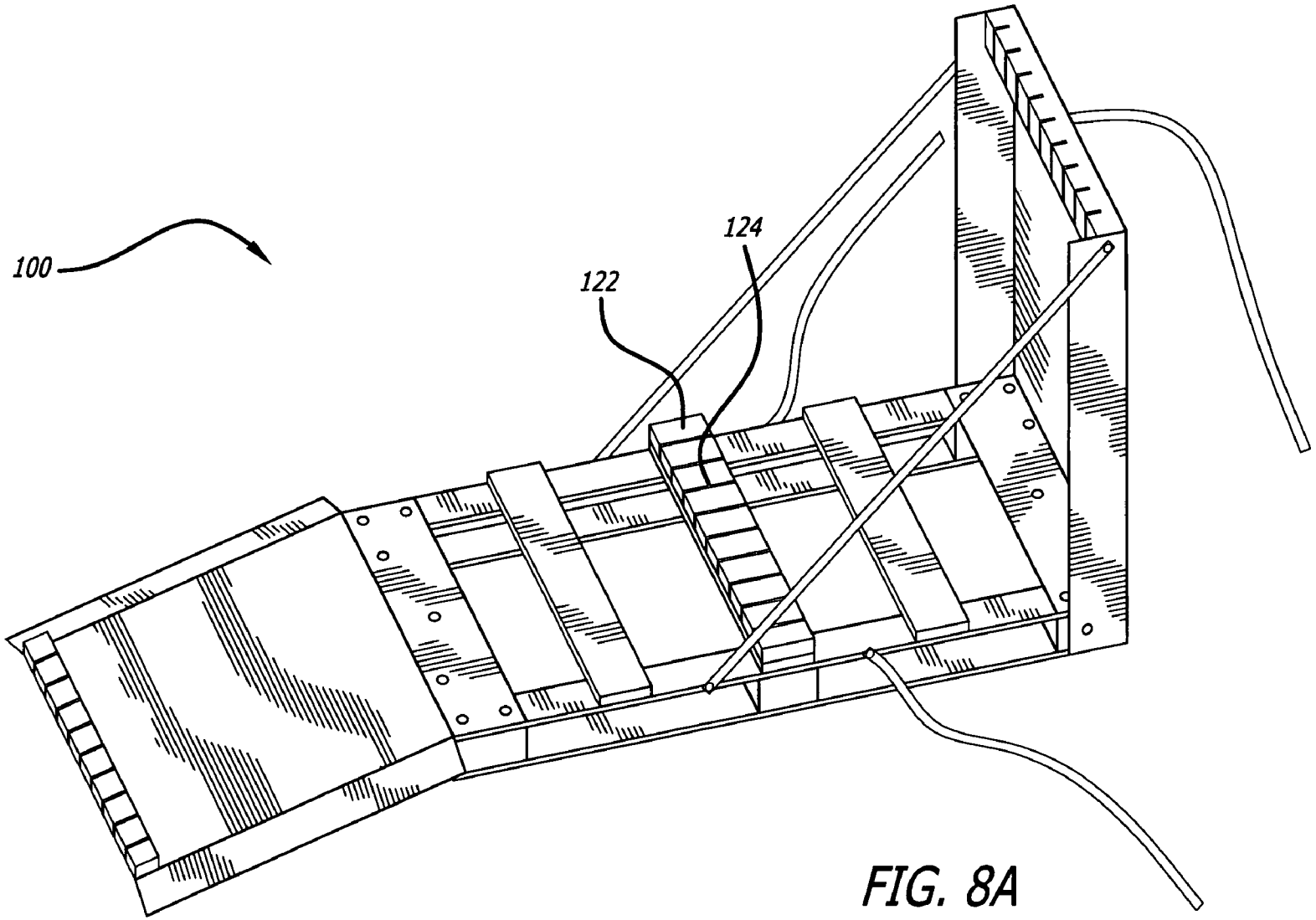
FIG. 8A is a perspective side view of another embodiment of a pallet.

Referring to FIG. 8A, a pallet 100 representing an alternative preferred embodiment of the present invention is shown. Pallet 100 includes substantially the same features as pallet 10, except that pallet 100 includes a single support member 122 instead of two spaced apart support members 22*a*, 22*b*. Support member 122 extends across the length of base 111. Preferably, the structure of support member 122 is identical to the structure of support members 22*a*, 22*b* shown in FIG. 1. Pallet 100 is typically used for holding smaller-sized window frames, while pallet 10 is typically used for holding larger-sized window frames.

Although pallet 10 is shown as having two supporting members 22*a*, 22*b* and pallet 100 is shown as having one supporting member 122, the number of supporting members on a base of a pallet can vary based on the length of the base and based on the size and weight of window frames loaded onto the pallet. In addition, the height and width of supporting members 22*a*, 22*b*, and 122, as well as the depth of their slots, can be varied to accommodate window frames of different sizes.

Figure 9:
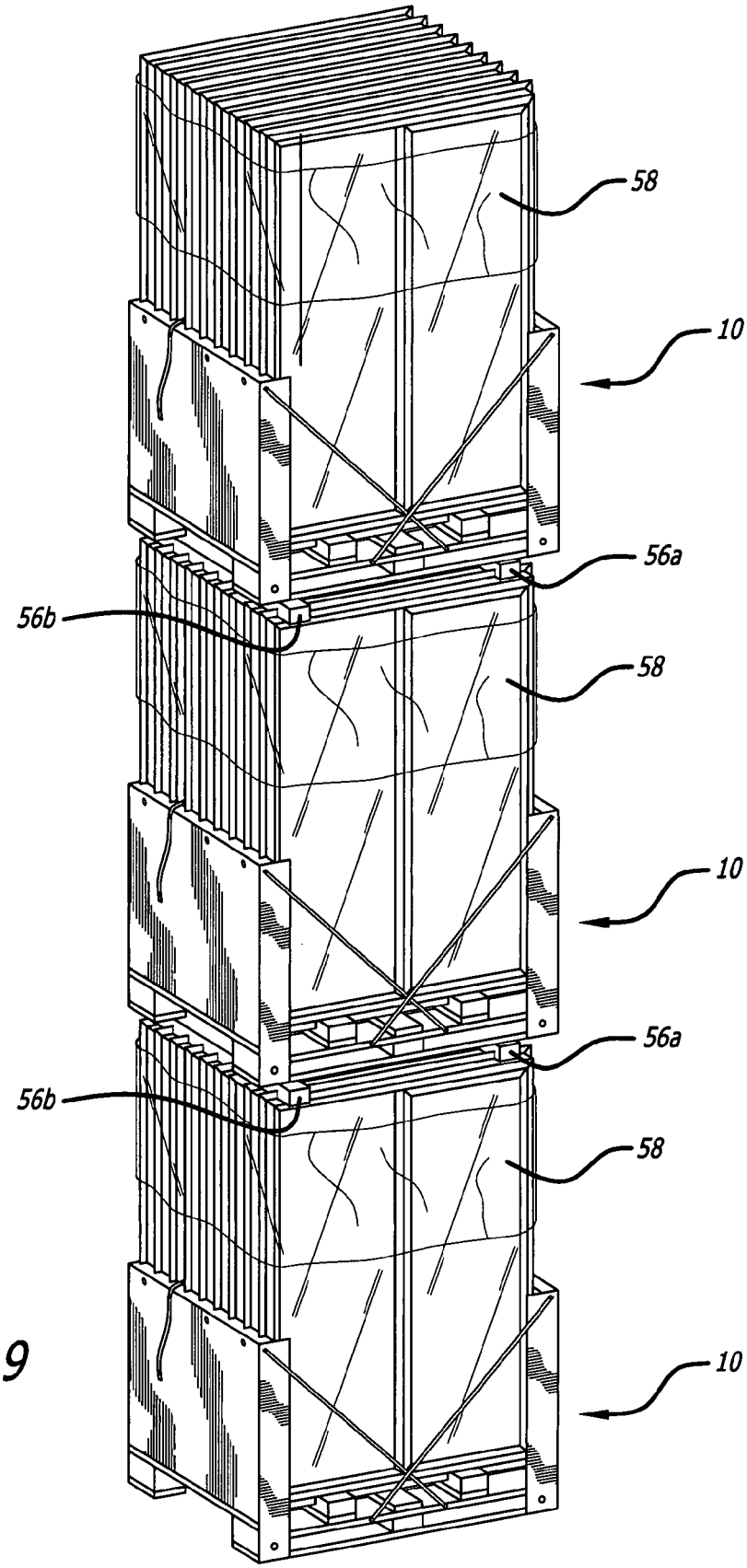
FIG. 9 is a perspective view of pallets loaded with windows and in a stacked arrangement.

As shown in FIG. 9, pallets of the present invention, such as pallets 10 and 100, can be securely stacked on top of one another to facilitate more efficient storage or transportation of window frames. Three stacked pallets 10 are illustrated in FIG. 9. Two slotted stacking blocks 56*a*, 56*b* are positioned on top of the nine window frames 52 loaded on the bottom pallet 10. Stacking blocks 56*a*, 56*b* each include nine slots, each slot receiving a fin 54 of each of the nine window frames 52. Second pallet 10 is placed on top of stacking blocks 56*a*, 56*b*. Two additional stacking blocks 56*a*, 56*b* are positioned on top of window frames 52 loaded on second pallet 10 and a third pallet 10 is stacked on top of second pallet 10. Stacking blocks 56*a*, 56*b* provide stable support for stacked pallets 10 and allow two or more pallets to be securely stacked on top of one another. Although two stacking blocks 56*a*, 56*b* are illustrated in FIG. 9, three, four, or more stacking blocks could be used depending on the length and width of the pallets used. Preferably, as shown in FIG. 9, plastic wrapping 58 is placed on top of loaded window frames 52 prior to positioning of stacking blocks 56*a*, 56*b* on top of window frames 52 to protect window frames 52 from scratching or other damage during storage or transportation while stacked.

Although the illustrated embodiments show window frames loaded on pallet 10, other fragile items, such as glass windows, glass sheets, glass doors, or the like could also be loaded onto pallet 10. In addition, although the slots of the support members 22*a*, 22*b*, and the slots 49 of dividers 46, 48 are shown to be linear in the drawings, the slots could be curved so that pallet 10 can store and transport curved objects, such as, for example, car windshields.

Figure 8B:
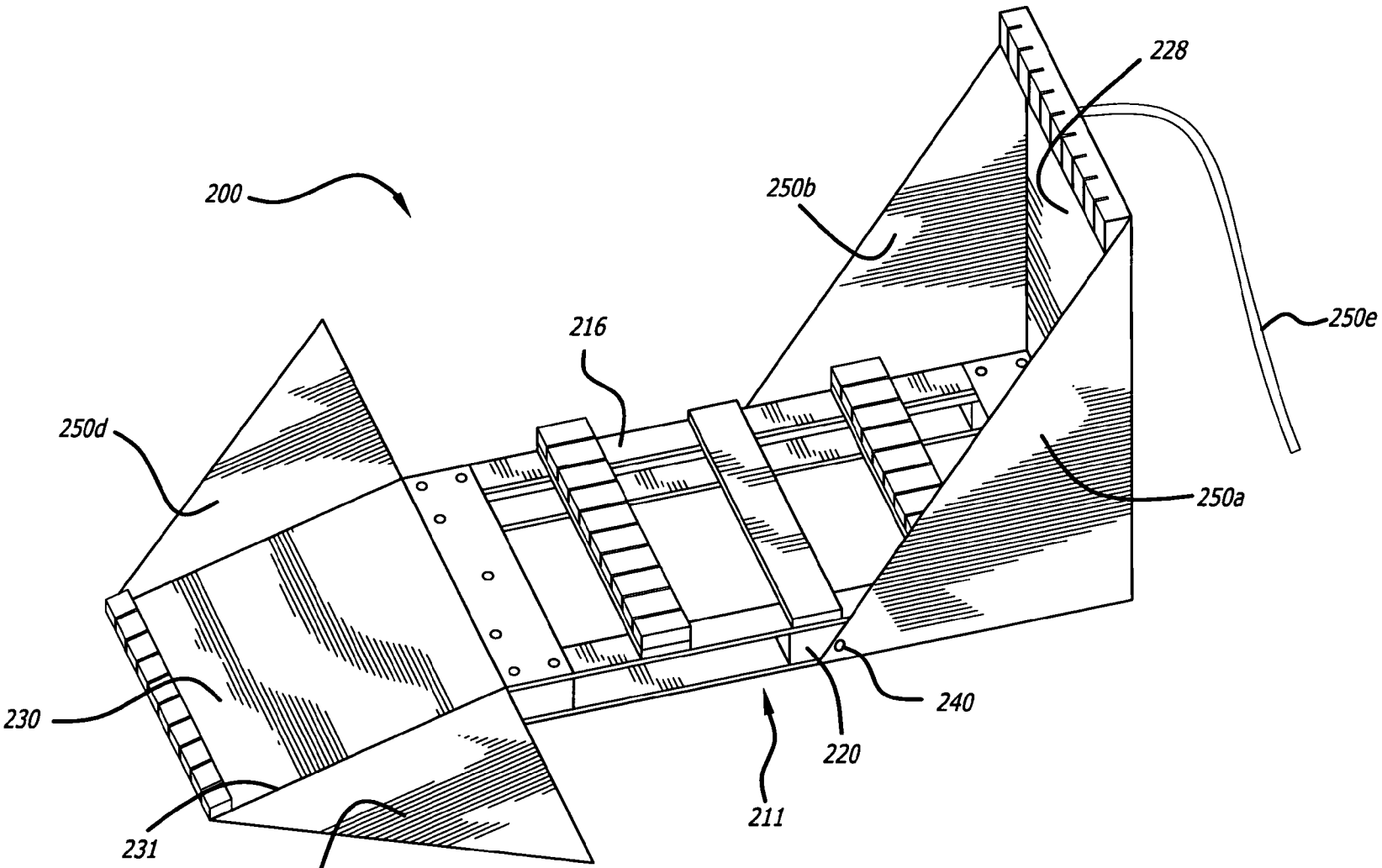
FIG. 8B is a perspective side view of another embodiment of a pallet.

FIG. 8B shows a pallet 200 representing another preferred embodiment of the present invention. Although the illustrated embodiments show movable sides 28, 30 connected to base 11 by a plurality of straps 50*a*-50*d*, other suitable connectors may be used to connect first and second movable sides 28, 30 to base 11. For example, pallet 200 includes substantially the same features as pallet 10, except that pallet 200 includes four extensions 250*a*-250*d* extending two each from first and second movable sides 228, 230, respectively. Preferably, extensions 250*a*-250*d* are made of the same corrugated plastic material as movable sides 228, 230, but could be made of other materials such as other plastics, cardboards, acrylics, or metals, or other materials suitable for the intended purpose.

Preferably, extensions 250*a*, 250*b* are in a pivotal relationship to first movable side 228, and extensions 250*c*, 250*d* are in a pivotal relationship to second movable side 230. In a preferred embodiment, movable sides 228, 230 include folds 231 forming a hinge to permit extensions 250*a*-250*d* to pivot from an open position (such as the position of extensions 250*c*, 250*d* in FIG. 8B) to an intermediate position (such as the position of extensions 250*a*, 250*b* in FIG. 8B). In addition, folds 231 permit extensions 250*a*-250 to pivot into a closed position utilized when first and second movable sides 228, 230 are collapsed (shown in FIG. 5) and pallet 200 is stored while not in use. Alternatively, other mechanical hinges may be used instead of folds 231. Folds 231 may be created, for example, by die cutting, welding, or scoring, or any other method of weakening the material of movable sides 28, 30 well known to those of ordinary skill in the art.

Extensions 250*a*, 250*b* connect first movable side 228 to base 211 of base 211 by a fastener such as, for example, screw 240. Extensions 250*a*, 250*b* hold first movable side 228 in a position substantially perpendicular to top 216 of base 211 and prevent first movable side 228 from moving in a direction away from second movable side 230.

After window frames are loaded onto pallet 200 and second movable side 230 is brought into a position substantially perpendicular to top 216 of base 211, extensions 250*c* and 250*d* are used to connect second movable side 230 to base 211. Extensions 250*c*, 250*d* hold second movable side 230 in a position substantially perpendicular to top 216 of base 211 and prevent second movable side 230 from moving in a direction away from first movable side 228.

Preferably, extensions 250*c*, 250*d* are attached to a respective support block 220 of base 211 by screw 240. In a preferred embodiment, extensions 250*a* and 250*c* are both attached to one support block 220 and extensions 250*b* and 250*d* are both attached to another support block 220. In other preferred embodiments, extensions 250*a*-250*d* could be attached to base 211 at points other than support blocks 220.

There is disclosed in the above description and the drawing, pallets for storing and transporting windows which fully and effectively overcome the disadvantages associated with the prior art. However, it will be apparent that variations and modifications of the disclosed embodiments may be made without departing from the principles of the invention. The presentation of the preferred embodiments herein is offered by way of example only and not limitation, with a true scope and spirit of the invention being indicated by the following claims.

What is claimed is:

1. A system for holding a window having a frame, said system comprising:

a pallet comprising:

a base having a first end, a second end opposite said first end, a length extending therebetween, a width transverse to said length, a top and a bottom and a height therebetween, at least a portion of said top proximate at least one of said first and second ends being in a plane transverse to said height;

at least one support member on said top of said base, said support member including at least one slot oriented along the length of said base configured to receive a portion of the window frame;

a first movable side and a second movable side each having a top end, a bottom end, a length extending therebetween, and a width transverse to said length, said bottom end of said first movable side and said bottom end of said second movable side each being attached to said base proximate said first and second ends of said base, respectively, each of said first and second movable sides including a hinge proximate said top of said base, said hinge in each of said first and second movable sides being formed by weakening a portion of a respective one of said first and second movable sides, at least one of said first and second movable sides being movable from a first position where said at least one of said first and second sides is substantially perpendicular to said top of said base to a second position where said top end of said at least one of said first and second movable sides is below the transverse plane of said base;

a first divider attached to said first movable side and a second divider attached to said second movable side, said first and second dividers extending across a portion of the width of a respective one of said first and second movable sides, each of said dividers having a first end, a second end, a longitudinal axis extending therebetween, and at least one slot oriented transverse to the longitudinal axis of each of said dividers and configured to receive respective portions of the window frame; and a plurality of straps each having opposite ends, each of said straps having a first portion proximate one of said opposite ends attachable to said base and a second portion proximate another one of said opposite ends attachable to one of said first and second movable sides, said straps when attached to said base and said first and second movable sides, respectively, preventing said first and second movable sides from moving away from each other when said first and second movable sides are in said first position; and at least one window frame having at least a portion receivable in said at least one slot of said support member, said at least one window frame having a top end, a bottom end, and a maximum height therebetween, said first and second movable sides each having a maximum height extending from said base of said pallet being less than the maximum height of said at least one window frame;

whereby said pallet is stackable above another pallet to facilitate storage or transportation of said at least one window frame.

2. The system of claim 1, wherein said at least one support member comprises two spaced apart support members, a first of said two support members having at least one slot, a second of said two support members having at least one slot aligned with said slot of said first support member to permit said slot of said first support member and said slot of said second support member to each receive respective portions of said at least one window frame.

3. The system of claim 1, wherein said at least one support member is made of at least one material selected from the group consisting of: cardboard, plastic, foam, rubber, wood, and metal.

4. The system of claim 1, wherein said at least one support member comprises a hexacomb cross-section.

5. The system of claim 1, wherein said at least one support member is attached to said top of said base by a mechanical fastener.

6. The system of claim 1, wherein said at least one window frame includes a fin extending therefrom, and wherein said at least one slot of said at least one support member and said at least one slot of said first and second dividers each have a dimension configured to receive a respective said fin of said at least one window frame.

7. The system of claim 1, wherein said maximum height of each of said first and second movable sides is greater than one half of the length of said base of said pallet.

8. The system of claim 1, wherein said maximum height of each of said first and second movable sides is less than one half of the length of said base of said pallet.

9. The system of claim 1, wherein said first and second dividers are attached to said first and second movable sides, respectively, by at least one mechanical fastener.

10. The system of claim 1, wherein said first and second dividers are made of at least one material selected from the group consisting of: cardboard, plastic, foam, rubber, wood, and metal.

11. The system of claim 1, further comprising a securing strap having a first portion attachable to said first movable side and a second portion attachable to said second movable side, said securing strap holding said first and second movable sides substantially perpendicular to said top of said base.

12. The system of claim 11, wherein said securing strap is attached to said first movable side by a mechanical fastener and wherein said securing strap is attached to said second movable side by a mechanical fastener.

13. A system for holding a window having a frame, said system comprising:

a pallet comprising:

a base having a first end, a second end opposite said first end, a length extending therebetween, a width transverse to said length, a top and a bottom and a height therebetween, at least a portion of said top proximate at least one of said first and second ends being in a plane transverse to said height;

a first movable side and a second movable side each having a top end, a bottom end, a length extending therebetween, and a width transverse to said length, said first movable side and said second movable side each including at least one slot configured to receive a portion of the window frame, said bottom end of said first movable side and said bottom end of said second movable side each being attached to said base proximate said first and second ends of said base, respectively, each of said first and second movable sides including a hinge proximate said top of said base, said hinge in each of said first and second movable sides being formed by weakening a portion of a respective one of said first and second movable sides, at least one of said first and second movable sides being movable from a first position where said at least one of said first and second sides is substantially perpendicular to said top of said base to a second position where said top end of said at least one of said first and second movable sides is below the transverse plane of said base; and a plurality of connectors, each of said connectors having a first portion attachable to said base and a second portion attachable to one of said first and second movable sides, said connectors when attached to said base and said first and second movable sides, respectively, preventing said first and second movable sides from moving away from each other when said first and second movable sides are in said first position; and at least one window frame having at least a portion receivable in said slot of one of said movable sides, said at least one window frame having a top end, a bottom end, and a maximum height therebetween, said first and second movable sides each having a maximum height extending from said base of said pallet being less than the maximum height of said at least one window frame;

whereby said pallet is stackable above another pallet to facilitate storage or transportation of said at least one window frame.

14. The system of claim 13, further comprising at least one slot in said top of said base configured to receive a portion of said at least one window frame.

15. The system of claim 13, wherein said slot in said top of said base, said slot in said first movable side, and said slot in said second movable side are each adapted to receive a respective portion of said at least one window frame.

16. The system of claim 13, wherein said connectors are selected from the group consisting of straps and extensions of said first and second movable sides.

17. The system of claim 13, wherein each of said first and second movable sides includes a second hinge adapted to permit each of said connectors to pivot from a first position where said connectors are parallel to a respective one of said first and second movable sides to a second position where each of said connectors is perpendicular to a respective one of said first and second movable sides.

18. The system of claim 13, wherein said connectors are generally triangular.

19. The system of claim 13, wherein said first and second movable sides and said connectors are made of the same material.

20. The system of claim 13, further comprising a first divider attached to said first movable side and a second divider attached to said second movable side, each of said first and second dividers extending across a portion of the width of a respective one of said first and second movable sides and having at least one slot configured to receive respective portions of said at least one window frame, at least a portion of said first divider being at the top end of said first movable side and at least a portion of said second divider being at the top end of said second movable side.

21. The system of claim 13, wherein the maximum height of each of said first and second movable sides is constant across the respective widths of said first and second movable sides.

22. The system of claim 13, further in combination with at least one stacking block having a plurality of slots configured to receive a portion of said at least one window frame, said stacking block being positionable between said top end of said at least one window frame and a base of a vertically adjacent window pallet.

23. The system of claim 1, wherein said straps, when attached to said base of said pallet and said first and second movable sides, respectively, intersect one another.

24. The system of claim 1, wherein said at least one of said first and second movable sides is adapted to be movable to a position where said movable side forms a ramp adapted to permit said at least one window frame to be loaded onto said base of said pallet.

25. The system of claim 1, wherein each of said first and second movable sides pivot about a first pivot axis and a second pivot axis, respectively, at least one of the first and second pivot axes being in the plane transverse to said height of said base.

26. The system of claim 1, wherein at least a portion of said first divider is at the top end of said first movable side and at least a portion of said second divider is at the top end of said second movable side.

27. The system of claim 1, wherein the maximum height of each of said first and second movable sides is constant across the respective widths of said first and second movable sides.

28. The system of claim 1, further in combination with at least one stacking block having a plurality of slots configured to receive a portion of said at least one window frame, said stacking block being positionable between said top end of said at least one window frame and a base of a vertically adjacent window pallet.

* * * * *